US006450931B1

(12) United States Patent
Frey

(10) Patent No.: US 6,450,931 B1
(45) Date of Patent: Sep. 17, 2002

(54) DEVICE FOR REMOVING EYELETS

(76) Inventor: Helmut Frey, Birkenweg 16, D-66333 Völklingen (DE)

( * ) Notice: Subject to any disclaimer, the term of this patent is extended or adjusted under 35 U.S.C. 154(b) by 0 days.

(21) Appl. No.: 09/554,770

(22) PCT Filed: Nov. 5, 1998

(86) PCT No.: PCT/DE98/03221

§ 371 (c)(1),
(2), (4) Date: Jul. 10, 2000

(87) PCT Pub. No.: WO99/26506

PCT Pub. Date: Jun. 3, 1999

(30) Foreign Application Priority Data

Nov. 24, 1997 (DE) ..... 197 51 960

(51) Int. Cl.[7] ..... B23Q 3/155; B23P 19/04

(52) U.S. Cl. ..... 483/28; 294/100; 29/235; 29/252; 29/253; 29/282; 29/243.53; 29/426.5; 29/283

(58) Field of Search ..... 29/235, 252, 426.5, 29/255, 283, 719, 33 R, 243.53, 426.6, 253, 282, 259, 261; 294/100; 483/28–29

(56) References Cited

U.S. PATENT DOCUMENTS

| | | | | | |
|---|---|---|---|---|---|
| 277,369 | A | * | 5/1883 | Spencer | 227/15 |
| 1,141,742 | A | * | 6/1915 | Wiseman | 294/100 |
| 1,456,943 | A | * | 5/1923 | Smith | 294/100 |
| 2,520,974 | A | * | 9/1950 | Spinnato | 29/282 |
| 2,646,619 | A | * | 7/1953 | McCord | 29/263 |
| 2,669,896 | A | * | 2/1954 | Clough | 294/100 |
| 2,787,923 | A | * | 4/1957 | Wooliver | 29/252 |
| 3,339,263 | A | * | 9/1967 | Dodge | 29/252 |
| 3,538,591 | A | * | 11/1970 | Reynolds et al. | 29/252 |
| 3,947,945 | A | * | 4/1976 | Gulistan | 29/426.5 |
| 4,214,362 | A | * | 7/1980 | Beard | 29/252 |
| 4,489,471 | A | * | 12/1984 | Gregory | 29/252 |
| 4,570,839 | A | * | 2/1986 | Cox et al. | 227/1 |
| 4,694,984 | A | * | 9/1987 | Altwicker | 29/243.53 |
| 4,703,882 | A | * | 11/1987 | Herten | 227/8 |
| 4,757,589 | A | | 7/1988 | Katsufumi | |
| 4,780,945 | A | | 11/1988 | Goeran | |
| 4,799,611 | A | * | 1/1989 | Taga | 227/18 |
| 5,234,147 | A | * | 8/1993 | Greenwalt | 227/149 |
| 5,249,342 | A | * | 10/1993 | Smith | 29/252 |
| 5,337,463 | A | * | 8/1994 | Rossler et al. | 29/243.521 |
| 5,787,561 | A | * | 8/1998 | Harmand | 29/255 |

FOREIGN PATENT DOCUMENTS

| | | | |
|---|---|---|---|
| DE | 215 403 | | 10/1909 |
| DE | 32 16 179 | | 11/1983 |
| DE | 36 33 539 | | 4/1988 |
| EP | 0655205 | A2 * | 5/1995 |
| GB | 251 773 | | 5/1926 |

* cited by examiner

*Primary Examiner*—A. L. Wellington
*Assistant Examiner*—Erica E Cadugan
(74) *Attorney, Agent, or Firm*—Henry M. Feiereisen

(57) ABSTRACT

A device for removing eyelets, in particular stainless steel eyelets, from textile or plastics sheets is provided. Eyelets in textiles or plastics sheets, for example in lorry tarpaulins, wear through in the course of their use and thus have as a rule a significantly shorter service life than the textile or plastics sheet. Thus, it is usual and economically worthwhile to replace the worn-through eyelets with new ones, in order thus to be able to exploit the total service life of the textile or plastics sheet. The removal of eyelets previously has been effected as a rule by hand, which is time consuming and uneconomical. Thus, there is provided a device for removing eyelets, in particular stainless steel eyelets, from textile or plastics sheets, having a claw head for pressing a beading of the eyelet in the direction of the eyelet center point or in the opposite direction.

7 Claims, 7 Drawing Sheets

DEVICE FOR REMOVING EYELETS

Figure 1:
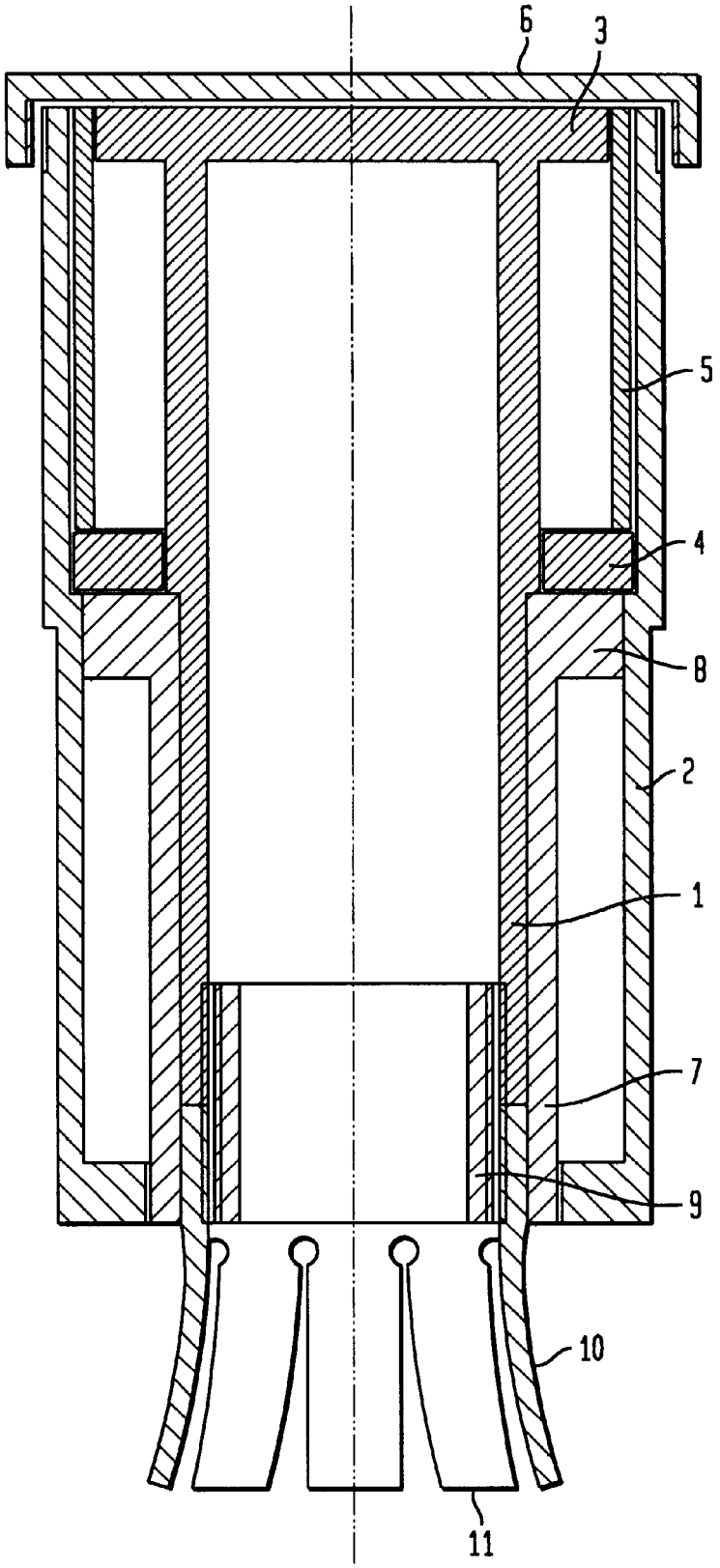

This is a United States national stage application of International Application No. PCT/DE98/03221, filed Nov. 5, 1998, which in turn claims the benefit of German Patent Application No. 197 51 960.1, filed Nov. 24, 1997, the benefit of the filing date of which is hereby claimed under 35 U.S.C. §119.

Device for removing eyelets, in particular stainless steel eyelets, from textile or plastics sheets.

Eyelets in textile or plastics sheets, for example in lorry tarpaulins, wear through in the course of their use and thus have, as a rule, a service life which is significantly less than the textile or plastics sheets. For this reason it is usual and economically worthwhile to replace the worn-through eyelets with new ones, in order thus to be able to exploit the total service life of the textile or plastics sheet.

From DE 36 33 539 A1 there is known a device for placing metal eyelets into the tarpaulins of lorries, or the like, which consists of a tool holding the eyelet upper part and a tool holding the eyelet lower part, whereby the two tools can be brought together in such a way that the tube-shaped neck of the eyelet upper part engages through the preperforated tarpaulin and its free edge is flanged around behind the inner edge of the ring-shaped eyelet lower part, the tool holding the eyelet lower part being arranged in the tool receiver of a hydraulic stamping cylinder and the tool holding the eyelet upper part being arranged in the tool receiver of an hydraulic flanging cylinder, and the two cylinders being connected with one another with an approximately semicircular yoke. Although it is proposed in this document to use the device also for the removal of eyelets, in that stamping tools are placed in the tool receivers of the two cylinders, with which stamping tools the inner edge of the metal eyelet is cut off, this configuration variant has not found favour. The reason for this can be understood to be that the device is relatively bulky and that the stamping off of the inner edge requires high pressures (higher pressures than the flanging), and leads to damage to the tarpaulin.

From DE 93 15 550.6 U1 there is known a tool for placing eyelets, in particular stainless steel eyelets, into textile or plastics sheets, which likewise is of a tool element holding the eyelet shaft part and, positioned opposite thereto in the usage disposition, a counter-element, holding the eyelet disc, with the interposition of the sheet, whereby there is provided for guiding the eyelet shaft part a centrally movable stamp, which slightly projects beyond the free edge contour of the eyelet shaft part, and an embossing stamp, surrounding the central stamp, movable relatively thereto, for embossing self-stamping eyelet shaft parts. This device is not suitable for the removal of eyelets.

From EP 0 655 205 A2, finally, there is known a press driven by a pressure medium, in particular an hydraulic eyelet press, for perforating sheets and emplacing edge reenforcing eyelets for the hole. This press consists of a cylinder housing with two pistons, nested within one another, of which one deals with the flanging operation and the other the hole stamping operation. Here also, no possibility for the removal of eyelets is provided, so that the removal of the eyelets must be effected manually.

It is thus found to be the case that in practice eyelets are still opened in a complicated manner by hand, which is uneconomic.

From DE 32 16 179 C2 there is known a device for releasing fixedly rivetted eyelets which reinforce the edge region of openings in a sheet. The device has on the one hand a stamp and on the other hand a stamp receiver which with their oppositely acting cutters separate an inner ring zone of the eyelet from an outer ring region of the eyelet. However, this solution has not found favour in practice.

It is thus the object of the invention to provide a device for the removal of eyelets, in particular stainless steel eyelets, from textile or plastics sheets, which is easy to handle and which is economic in manufacture.

The object is achieved in that there are provided means for pressing a beading of the eyelet in the direction of the eyelet middle point or in the opposite direction.

One configuration of the invention consists in that, as means for pressing the beading of the eyelet, there is provided a substantially cylindrical or oval claw head having claws that can be spread apart from one another and can be closed.

It is within the scope of the invention that the claw head is formed as a substantially cylindrical tube section and has a plurality of claws separated from one another by means of axial incisions, which claws are, in the non-operative condition, spread apart from one another, and which can be pressed together by means of pushing over a control cylinder, over at least a part of the claw head.

Thereby, it is advantageous that at least 8 claws are provided.

Another configuration of the invention consists in that the claw head consists of radial claws attached at the end of a cylindrical tube section in a jointed manner, which claws can be spread apart from another by means of drawing a cone arranged within the claws, and which can be pressed together by pushing over a control cylinder over at least a part of the claw head.

A further development of the invention consists in that the claw head can be connected with a carrier tube which is displaceable, by means of pressure medium, within a housing, towards its forward end, and in that a control cylinder is arranged around the carrier tube, which control cylinder can be carried along with the carrier tube upon displacement thereof, and in that the control cylinder is displaceable, by means of a pressure medium, with respect to the carrier tube located in an end position, further in the direction of the forward end of the housing, over at least a part of the claw head.

It can also be provided that the claw head is connectable with a carrier tube which, by means of pressure medium, is displaceable within a housing towards its forward end, and that a control cylinder is arranged around the carrier tube, which control cylinder can be carried along with the carrier tube upon displacement thereof, and that the control cylinder is displaceable, by means of a pressure medium, with respect of the carrier tube located in an end position, further in the direction of the forward end of the housing, over at least a part of the claw head, and that there is provided a displaceable cone arranged in the axial direction of the housing.

In accordance with the invention it is advantageous that an anvil part is connectable with the housing, onto which anvil part the eyelet to be released can be brought.

It is also expedient that the device has means for stamping holes in the textile or plastics sheets.

It likewise lies within the scope of the invention that the device has means for placing eyelets in the textile or plastics sheets.

Further, it is useful that for stamping of holes a stamp head can be connected with the carrier tube, and for the applying of eyelets, a rivetting head can be connected with the carrier tube.

Finally, it is advantageous if the anvil part has a magnet.

The advantages of the present invention lie in substance in that a device is provided with which eyelets can be opened with the application of relatively little force. Due to the relatively slight pressures of the pressure medium necessary therefor, the device can be constructed handily and thus can be manufactured economically. With the device, eyelets can be removed directly at the installed textile or plastics sheet. By means of the possibility to use a stamping head or a rivetting head instead of the claw head, there is provided a tool suitable for all activities required in connection with eyelets.

In the following an exemplary configuration of the subject of the invention will be described with reference to drawings.

There is shown

Figure 2:
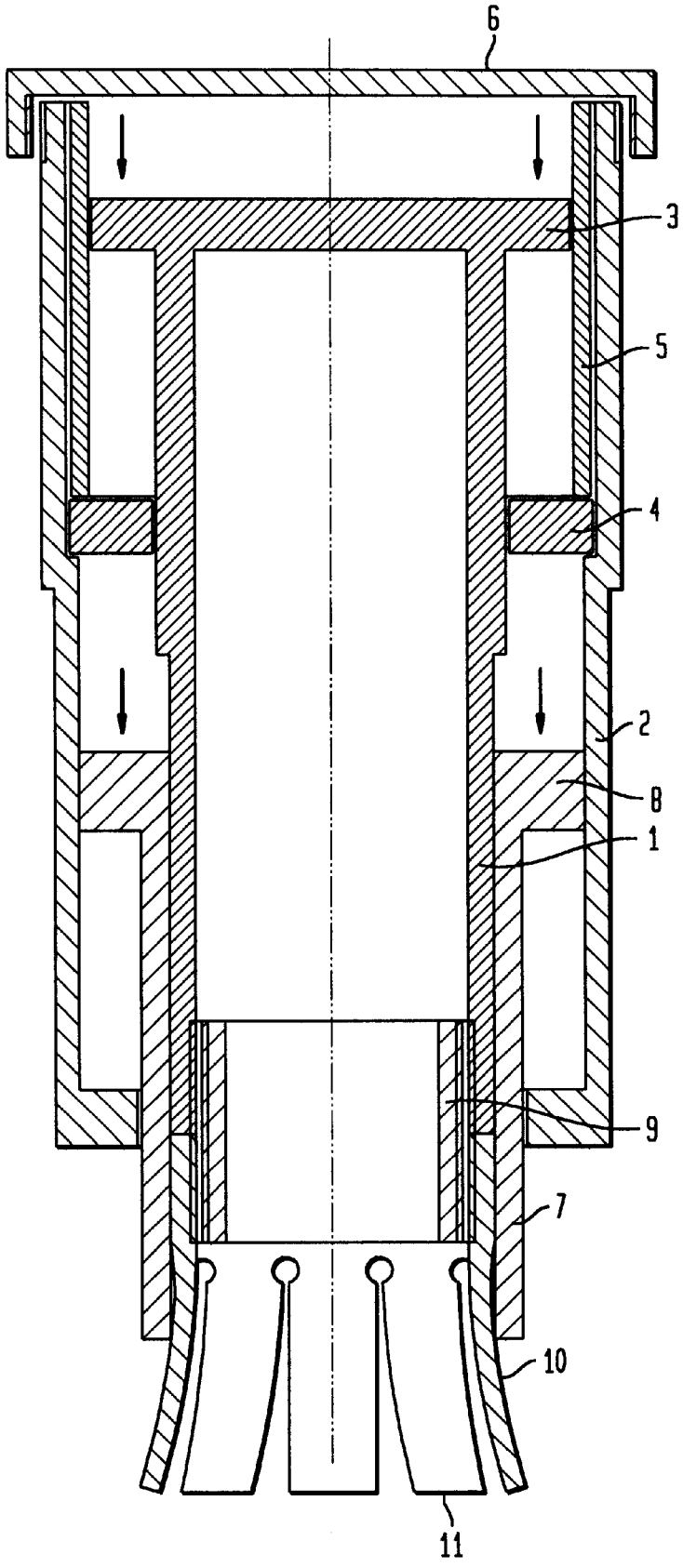
Figure 3A:
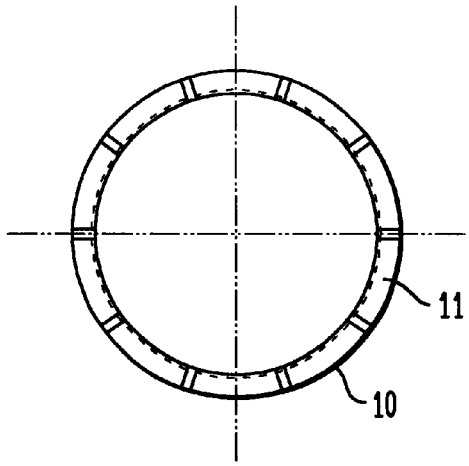
Figure 3B:
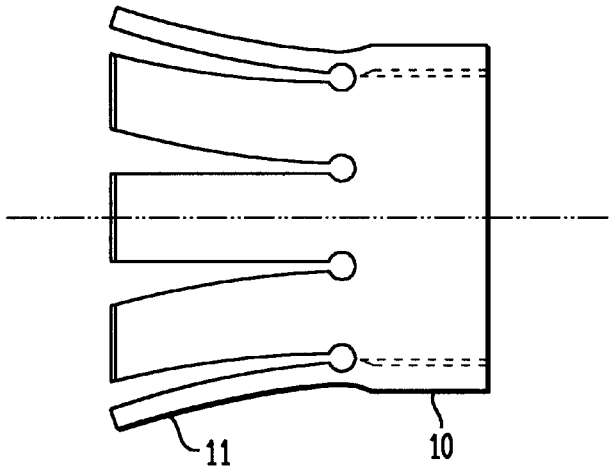
Figure 3C:
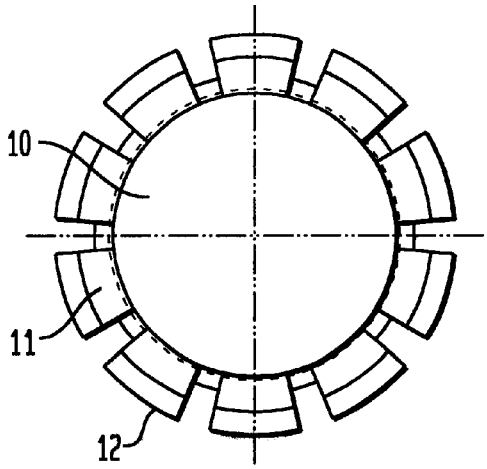
Figure 4:
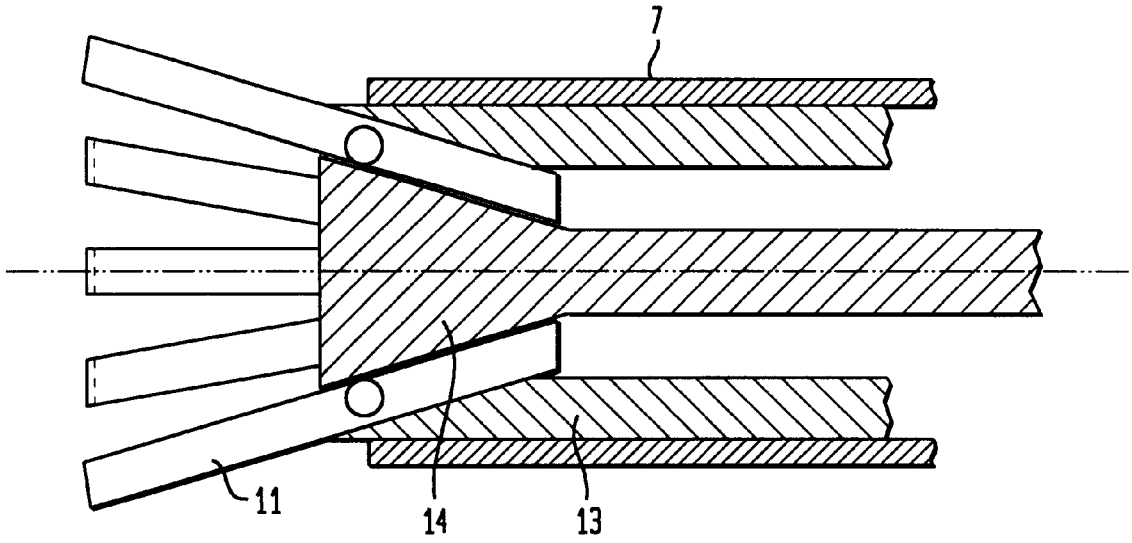
Figure 5:
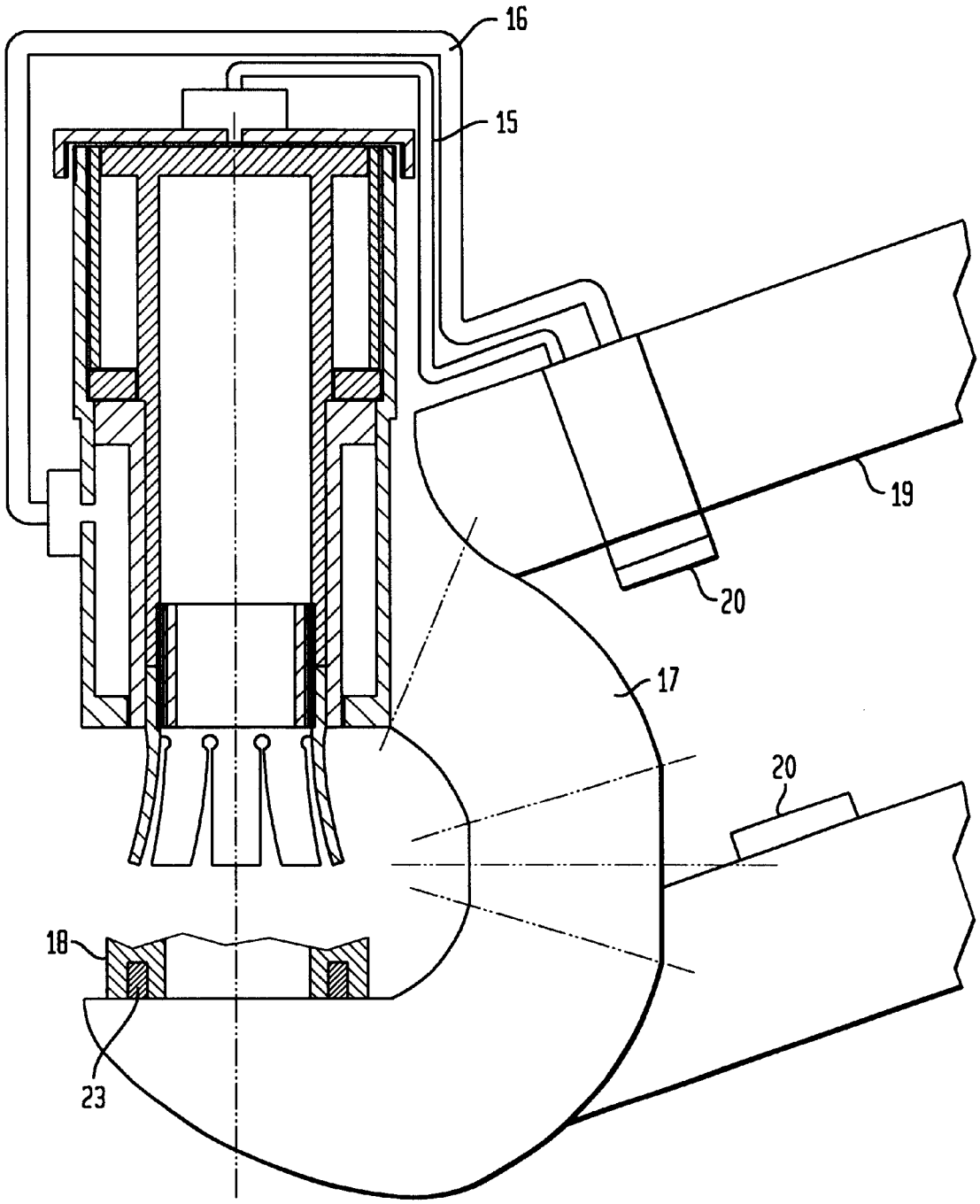
Figure 6:
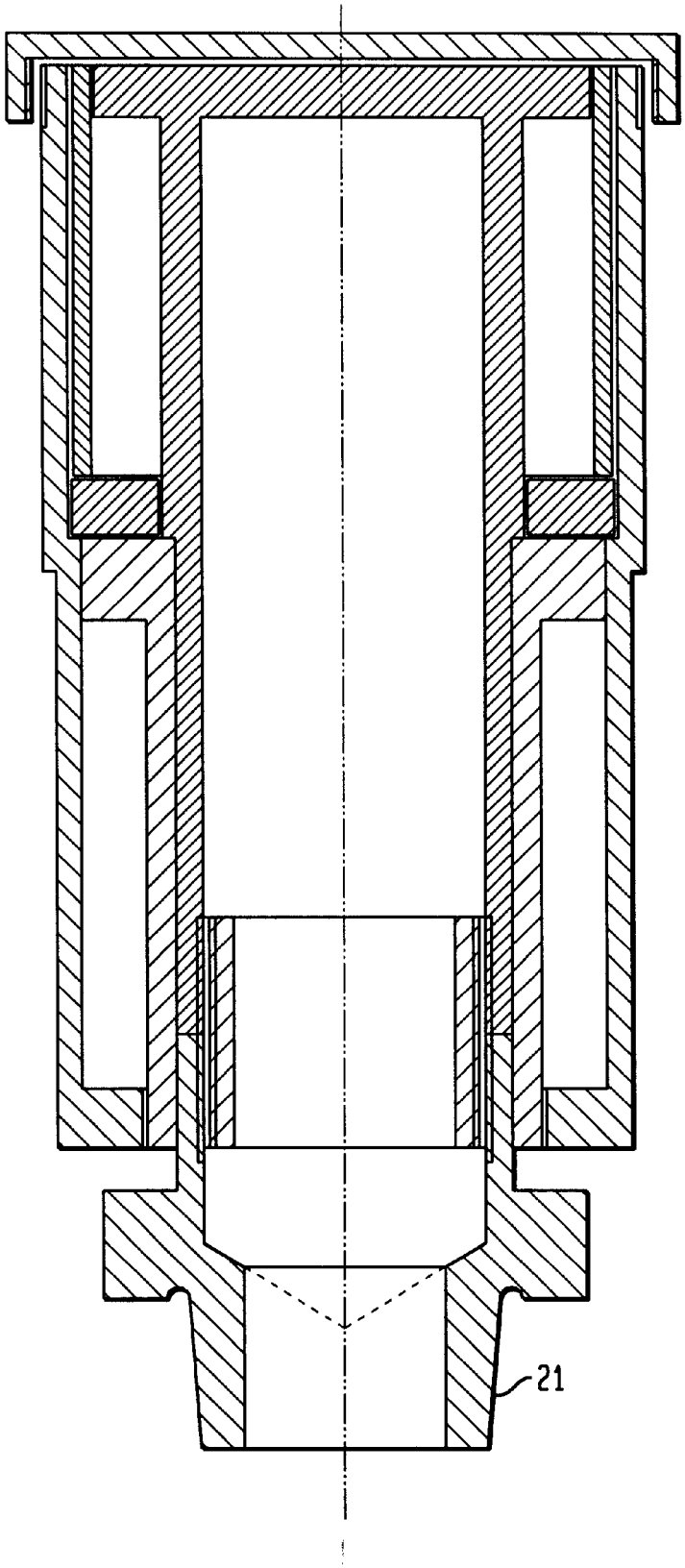
Figure 7:
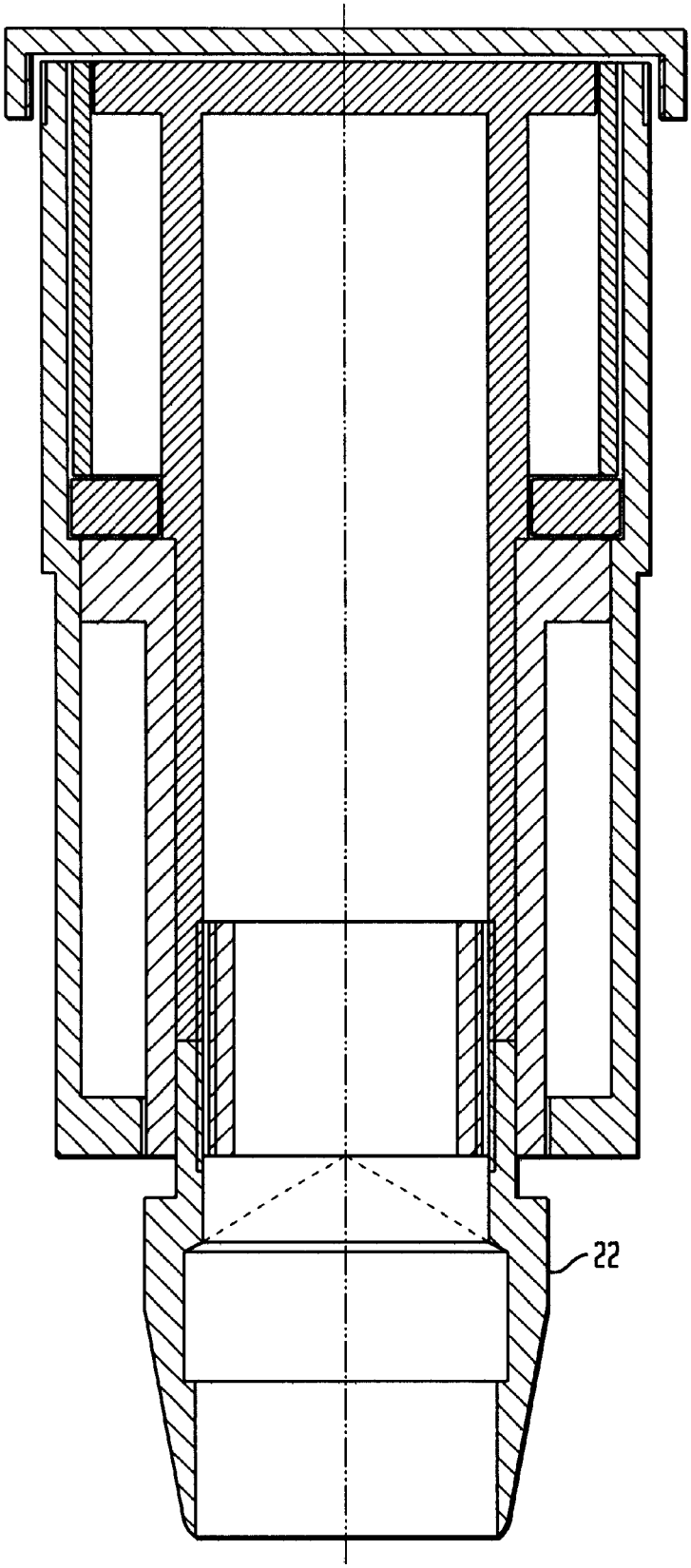

FIG. 1 a device in accordance with the invention in an initial condition (partial view), FIG. 2 a device in accordance with the invention in a working condition (partial view), FIGS. 3*a*, 3*b*, 3*c* a claw head in accordance with the invention, in a side view and in two views from above (opened and closed position), FIG. 4 another claw head in accordance with the invention, in a cut-away illustration, FIG. 5 a device in accordance with the invention in an overall view, FIG. 6 a device in accordance with the invention, with a rivetting head, FIG. 7 a device in accordance with the invention, with a stamping head.

As can be seen from FIGS. 1 and 2, the device in accordance with the invention consists of a carrier tube 1 which is axially displaceably arranged within a housing 2. The displacement of the carrier tube 1 is effected by action on the rear surface 3 of the carrier tube 1 with a is pressure medium, for example with compressed air or hydraulic oil. The carrier tube 1 can be displaced within the housing 2 up to a chamber ring 4, which is secured against the housing cover 6 by means of a support sleeve 5.

Around the carrier tube 1 there is arranged a control cylinder 7 which is form-fittingly connected with the carrier tube 1 and thus is carried along by means of the carrier tube 1 until the carrier tube 1 impacts on the chamber ring 4. The rear surface 8 of the control cylinder 7 can likewise be acted upon with a pressure medium, whereby the control cylinder 7 is displaced along the carrier tube 1 forwardly over the claw head 10. The carrier tube 1 has a threaded sleeve 9 upon which, in accordance with FIGS. 1 and 2, a claw head 10 is applied.

The claw head 10 can, as illustrated in FIGS. 1, 2 and 3*a*, 3*b* and 3*c*, be formed as a substantially cylindrical (or oval) tube section which has a plurality of spring elastic claws 11 separated from one another by means of axial incisions. In non-operative position (FIGS. 1, 2, 3*b*, 3*c*) the claws are spread apart from one another. Expediently, they have hooks 12 directed towards the middle axis of the claw head 10.

FIG. 3*a* shows how, through displacement of the control cylinder 7 over at least a part of the claw head 10, the claws 11 of the claw head are pressed together.

Another configuration of a claw head is illustrated in FIG. 4. Here, individual claws 11 are Pointedly attached to a cylindrical tube section 13, radially, so that with their forward ends they can be pivoted conically outwardly beyond the tube diameter (open position, FIG. 4) and can also be pivoted cylindrically approximately to the dimensions of the tube diameter (closed position). The pivoting outwardly is attained by means of a cone 14 drawn from the outside into the tube section 13, and the closed disposition is attained by means of movement of the cone in the direction out of the tube section 13 and by the action of the control cylinder 7 pressing on the outer region of the claw head 10.

In the overall view of FIG. 5, there are illustrated the pressure medium connections 15 for the carrier tube 1 and 16 for the control cylinder 7, and an anvil part 18 connected via a yoke 17 with the housing 2. The anvil part 18 serves for holding the eyelet. As illustrated, the yoke 17 may also have handgrips 19 on which there are expediently arranged the actuating members 20 for the device in accordance with the invention.

For removal of an eyelet, first the carrier tube 1 is acted upon with pressure medium and travels forwardly until it impacts on the chamber ring 4. By this means, the claw head 10 is moved into the open position over the beading of the eyelet located on the anvil part 18. Then, the control cylinder 7 is acted upon with pressure medium and likewise travels forwardly, whereby it travels at least partially over the claw head 10 and exerts pressure on its outer surface so that the claws 11 go from the spread-apart disposition into the closed disposition and thereby press the beading of the eyelet towards the eyelet middle point, until the eyelet is able to be removed. With eyelets with which the beading must be pressed outwardly, the movement is effected in the opposite direction.

Finally, FIGS. 6 and 7 show a rivetting head 21 and a cutting head 22 which can be placed in the device in accordance with the invention instead of the claw head 10. The rivetting head 21 serves in cooperation with the anvil part 18 for rivetting eyelets into the sheets in conventional manner.

The stamping head 22 serves for the production of holes in the sheet, e.g. after a repair of the sheet. For this purpose, a sleeve may be inserted over the anvil part 18, which sleeve is held by means of a magnet 23 located in the anvil part 18. The sleeve serves as counterpart to the stamping head 22 and has a depression corresponding to the stamp diameter.

Thus, with the device in accordance with the invention, and without removal of the sheets, repairs in the eyelet region can be effected directly at the vehicle. Also in the case of the replacement of eyelets in awnings, tenting etc., repair can be carried out without prior disassembly.

What is claimed is:

1. A device for removing an eyelet from textile or plastics sheets, comprising a substantially cylindrical or elliptical cylindrical claw head for pressing a beading of the eyelet in a direction of a middle point of the eyelet or in an opposite direction, wherein the claw head has claws which are moveable between a first position in which the claws are spread apart from one another and a second position in which the claws are closed, wherein the claw head is formed as a substantially cylindrical tube section having an axis, which tube section is constructed to include integrally therewith a plurality of the claws, which are axially-extending radially-spaced claws that are normally in the first position, a control cylinder configured for sliding over an outside of at least a part of the claw head to press together the claws into the second position, and an anvil for locating the eyelet to be removed with respect to the claw head.

2. The device of claim 1, wherein the eyelet is a stainless steel eyelet.

3. The device of claim 1, wherein the claw head has at least eight of the claws.

4. The device of claim 1, and further comprising a housing, and a carrier tube set within the housing for attachment of the claw head and acted upon by a pressure medium for displacement in a direction to and from a forward end of the housing, wherein the control cylinder is disposed in surrounding relationship to the carrier tube and is conjointly moveable with the carrier tube until the carrier tube reaches an end position, wherein the control cylinder is configured for further displacement by the pressure medium relative to the carrier tube so as to allow the control cylinder to slide over at least a part of the claw head and to move the claws into the operative position.

5. The device of claim 4, wherein the anvil is configured for connection to the housing for placement of the eyelet to be removed.

6. The device of claim 5, and further comprising a magnet integrated in the anvil.

7. A kit, comprising:

a pressure medium operated system including a carrier tube and a control cylinder operatively connected to the carrier tube and adapted for conjoint movement with the carrier tube as well as movement relative to the carrier tube;

wherein the carrier tube has means for interchangeably attaching any one of a claw head, stamping head, or a riveting head, the kit including:

the claw head being detachably connectable to the carrier tube, the claw head being for pressing a beading of an eyelet in a direction of a middle point of the eyelet or in an opposite direction to thereby allow removal of the eyelet from textile or plastics sheets, wherein the claw head has claws moveable between a first position, in which the claws are spread apart from one another, and a second position, in which the claws are closed, wherein the claw head is formed as a substantially cylindrical tube section having an axis, which tube section includes a plurality of axial incisions to form the claws, wherein the control cylinder is configured for sliding over an outside of at least a part of the claw head to press together the claws into the second position;

the stamping head being detachably connectable to the carrier tube for punching holes in the textile or plastic sheets; and the riveting head being detachably connectable to the carrier tube for placing an eyelet into the textile or plastics sheets an anvil for locating a portion of the textile or plastics sheets that is being operated on by a respective one of the claw head, the stamping head, or the riveting head with respect to the respective one of the claw head, the stamping head, or the riveting head.

* * * * *